US010881211B1

(12) United States Patent
Al-Salloom

(10) Patent No.: US 10,881,211 B1
(45) Date of Patent: Jan. 5, 2021

(54) COLLAPSIBLE CHAIR

(71) Applicant: Hamad M. A. H. Al-Salloom, Safat (KW)

(72) Inventor: Hamad M. A. H. Al-Salloom, Safat (KW)

( * ) Notice: Subject to any disclaimer, the term of this patent is extended or adjusted under 35 U.S.C. 154(b) by 0 days.

(21) Appl. No.: 16/776,486

(22) Filed: Jan. 29, 2020

(51) Int. Cl.
*A47C 4/04* (2006.01)
*A47C 3/34* (2006.01)
*A47C 7/00* (2006.01)

(52) U.S. Cl.
CPC ..... *A47C 4/04* (2013.01); *A47C 3/34* (2013.01); *A47C 7/006* (2013.01)

(58) Field of Classification Search
CPC .... A47C 4/04; A47C 4/08; A47C 4/10; A47C 4/12; A47C 4/18; A47C 4/20; A47C 4/22; A47C 3/34; A47C 7/006
See application file for complete search history.

(56) References Cited

U.S. PATENT DOCUMENTS 898,597 A 9/1908 Pattinson
1,379,374 A 5/1921 Wagner et al.
1,420,095 A * 6/1922 Gutter ..... A47C 4/045 297/44
1,963,835 A * 6/1934 Deland ..... A47C 4/045 297/44
2,292,586 A * 8/1942 Thompson ..... A47C 4/02 297/44
2,562,629 A 7/1951 Miles
4,218,089 A * 8/1980 Beltrami ..... A47C 1/124 297/248
4,359,243 A * 11/1982 Crutcher ..... G10G 7/005 297/16.1
4,824,171 A * 4/1989 Hollingsworth ..... A47C 1/146 297/351
8,651,567 B2 * 2/2014 Aldred ..... A47C 4/20 297/59
8,882,189 B2 * 11/2014 Voris ..... A47C 4/04 297/59
8,973,996 B2 3/2015 Daghistani
9,113,707 B2 * 8/2015 Moore ..... A47C 4/10
9,247,817 B2 * 2/2016 Grace ..... A47C 4/04
9,924,799 B2 * 3/2018 Banks ..... A47C 4/18
2007/0096524 A1 5/2007 Chou
2008/0263760 A1 10/2008 Meyers
2009/0079235 A1 3/2009 Huang
2009/0261643 A1 * 10/2009 Kay ..... A47C 4/20 297/335
2016/0309903 A1 * 10/2016 Huang ..... A47C 4/28

* cited by examiner

*Primary Examiner* — Philip F Gabler
(74) *Attorney, Agent, or Firm* — Nath, Goldberg & Meyer; Richard C. Litman

(57) ABSTRACT

The collapsible chair is foldable and collapsible in a variety of different configurations. The collapsible chair includes a seat frame having a rear bar and a pair of side bars. A seat is mounted on the seat frame, the seat having a rear edge pivotally attached to the rear bar of the seat frame and a front edge slidably and pivotally attached to the pair of side bars of the seat frame. Front and rear portions of the seat are selectively foldable with respect to one another and with respect to the seat frame. The chair has a plurality of legs, an upper end of each leg being pivotally attached to the seat frame and selectively foldable against the seat frame. The chair has a back rest having opposed upper and lower ends, the lower end being pivotally attached to the rear bar of the seat frame.

20 Claims, 17 Drawing Sheets

COLLAPSIBLE CHAIR

BACKGROUND

1. Field

The disclosure of the present patent application relates to seating, and particularly to a collapsible chair, which is foldable and collapsible in a variety of different configurations.

2. Description of the Related Art

Folding chairs are relatively old and well known, typically consisting of hinged legs, seats and back rests, allowing the seat to be folded against the back rest, and allowing the legs to move into a substantially co-planar position with respect to the folded seat and back rest. However, such folding chairs, although easier to carry and move than non-folding chairs, are still limited in their overall size and bulk by the size and shape of the seat, and by the length of the legs. The legs, in particular, by remaining parallel with respect to one another and extending downward from the seat, even in the folded position, make carrying such a foldable chair difficult for some people. Additionally, conventional folding chairs do not easily lend themselves to additional features, such as arm rests, since conventional arm rests would prevent the chairs from being folded. Thus, a collapsible chair solving the aforementioned problems is desired.

SUMMARY

The collapsible chair is foldable and collapsible in a variety of different configurations. The collapsible chair includes a seat frame having a rear bar and a pair of side bars, such that the seat frame has an open front end. A seat is mounted on the seat frame, the seat being divided into front and rear portions. A rear edge of the seat is pivotally secured to the rear bar of the seat frame, and a front edge of the seat is both slidably and pivotally secured to the pair of side bars of the seat frame. The front and rear portions of the seat are selectively foldable with respect to one another and with respect to the seat frame.

A plurality of legs are provided, each leg having an upper end and a lower end, the upper end of each leg being pivotally secured to the seat frame and being selectively foldable against the frame. A back rest is also provided, having opposed upper and lower ends, the lower end being pivotally secured to the rear bar of the seat frame. A substantially U-shaped carrying handle may be further provided, the handle having a pair of ends pivotally attached to front ends of the pair of side bars of the seat frame. Additionally, at least one caster may be secured to the rear bar of the seat frame.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
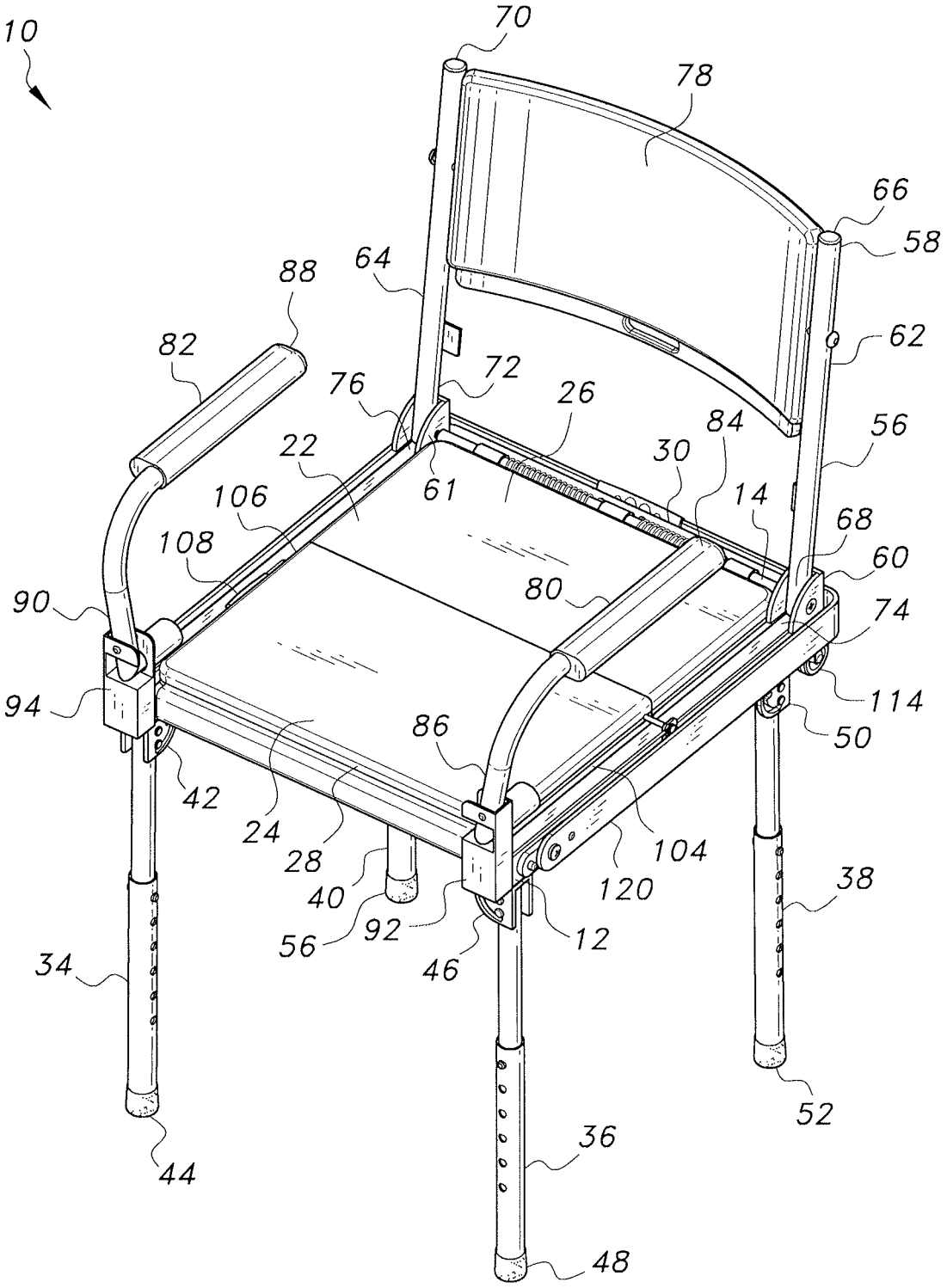
FIG. 1 is a perspective view of a collapsible chair.
Figure 3A:
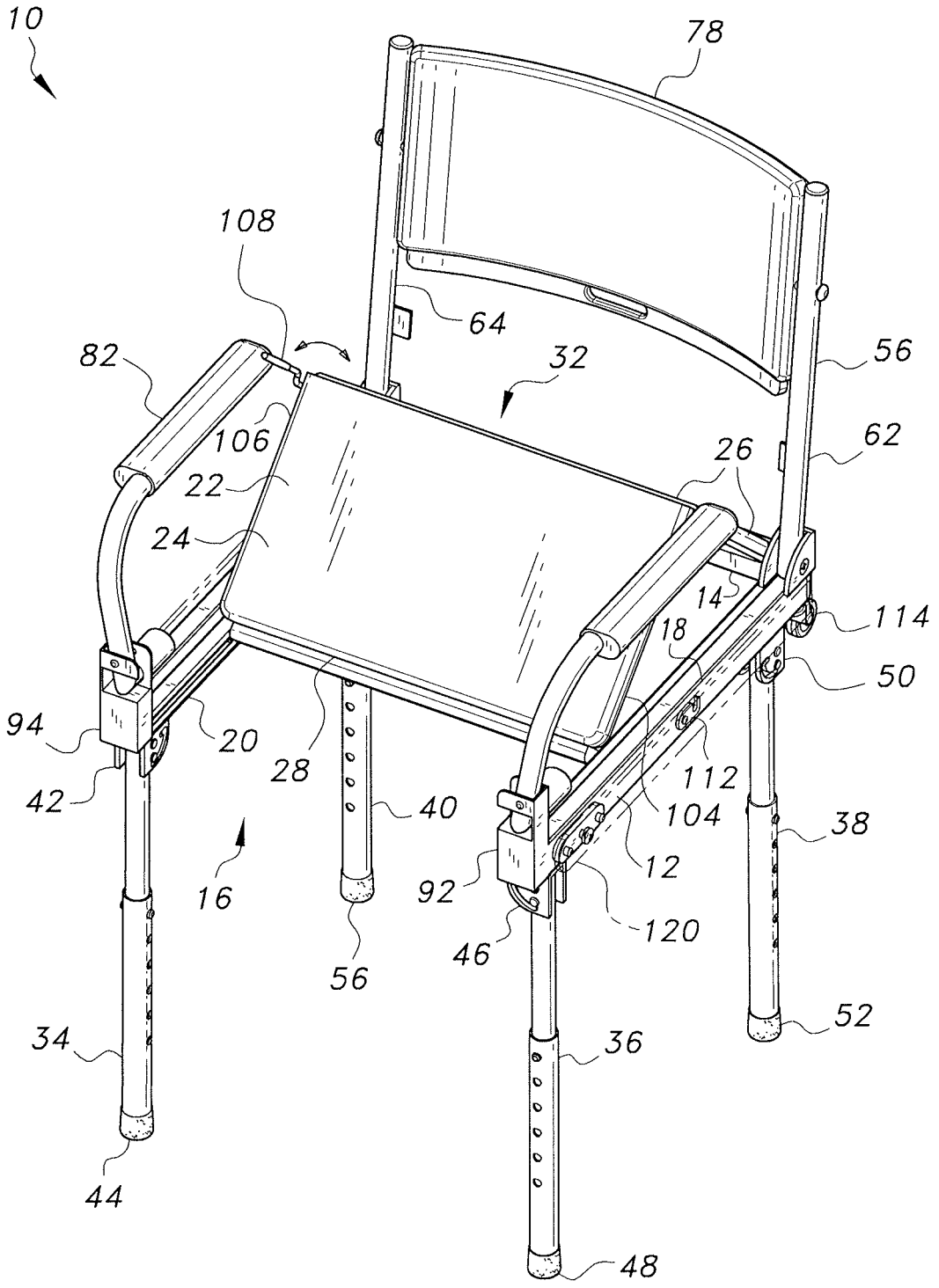
FIG. 3A is a perspective view of the collapsible chair of FIG. 1, showing the seat in a partially folded state.

The collapsible chair 10 is foldable and collapsible in a variety of different configurations. As shown in FIGS. 1 and 3A, the collapsible chair 10 includes a seat frame 12 having a rear bar 30 and a pair of side bars 18, 20, such that the seat frame 12 has an open front end 16. A seat 22 is mounted on the seat frame 12, the seat 22 being divided into front and rear portions 24, 26, respectively. It should be understood that the dimensions and configuration of the seat 22 (and its front and rear portions 24, 26, respectively) are shown for exemplary purposes only. Similarly, the dimensions and configuration of the seat frame 12 are shown to correspond to the exemplary seat 22, and may vary, depending upon the size, shape and relative dimensions of the seat 22.

A rear edge 14 of seat 22 is pivotally secured to the rear bar 30 of the seat frame 12 by a hinge or the like, and a front edge 28 of the seat 22 is both slidably and pivotally attached to the pair of side bars 18, 20 of the seat frame 12. As best seen in FIG. 3A, the front and rear portions 24, 26, respectively, of the seat 22 are selectively foldable with respect to one another about joint line 32 (e.g., by a piano hinge between the front and rear portions 24, 26), and also with respect to the seat frame 12. FIG. 1 shows the seat 22 in its fully deployed position. In FIG. 3A, the seat 22 is shown partially folded, and in FIG. 3B, the seat 22 is shown fully collapsed, folded against the back rest 56. As the seat 22 is folded from the position of FIG. 3A to the position of FIG. 3B, the front edge 28 of the seat 22 slides along tracks defined by side bars 18, 20.

Figure 2A:
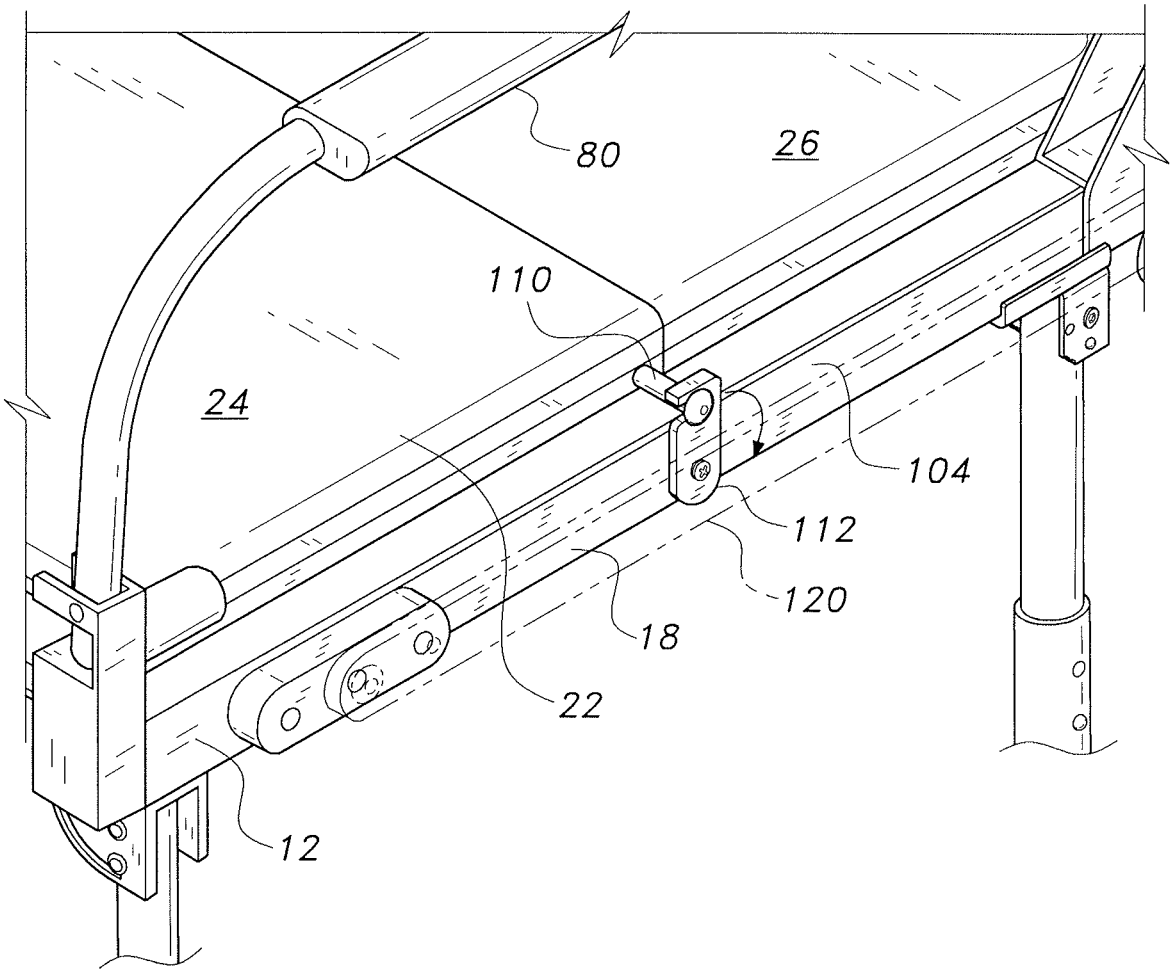
FIG. 2A is partial perspective view of the collapsible chair of FIG. 1, showing a hook engaging a post to lock a seat of the collapsible chair in a deployed position.
Figure 2B:
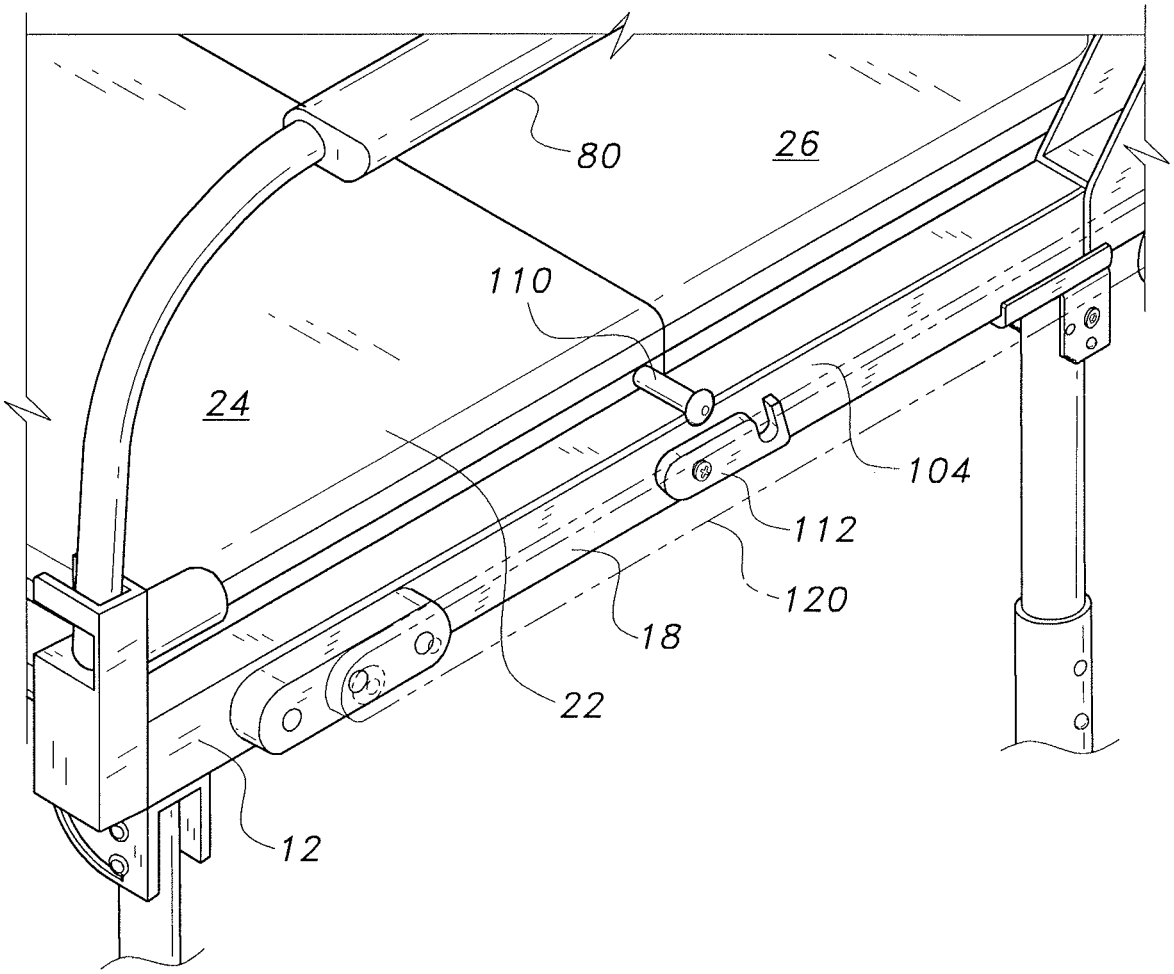
FIG. 2B is a partial perspective view of the collapsible chair of FIG. 2A, showing the hook disengaged from the post to unlock the seat.
Figure 3B:
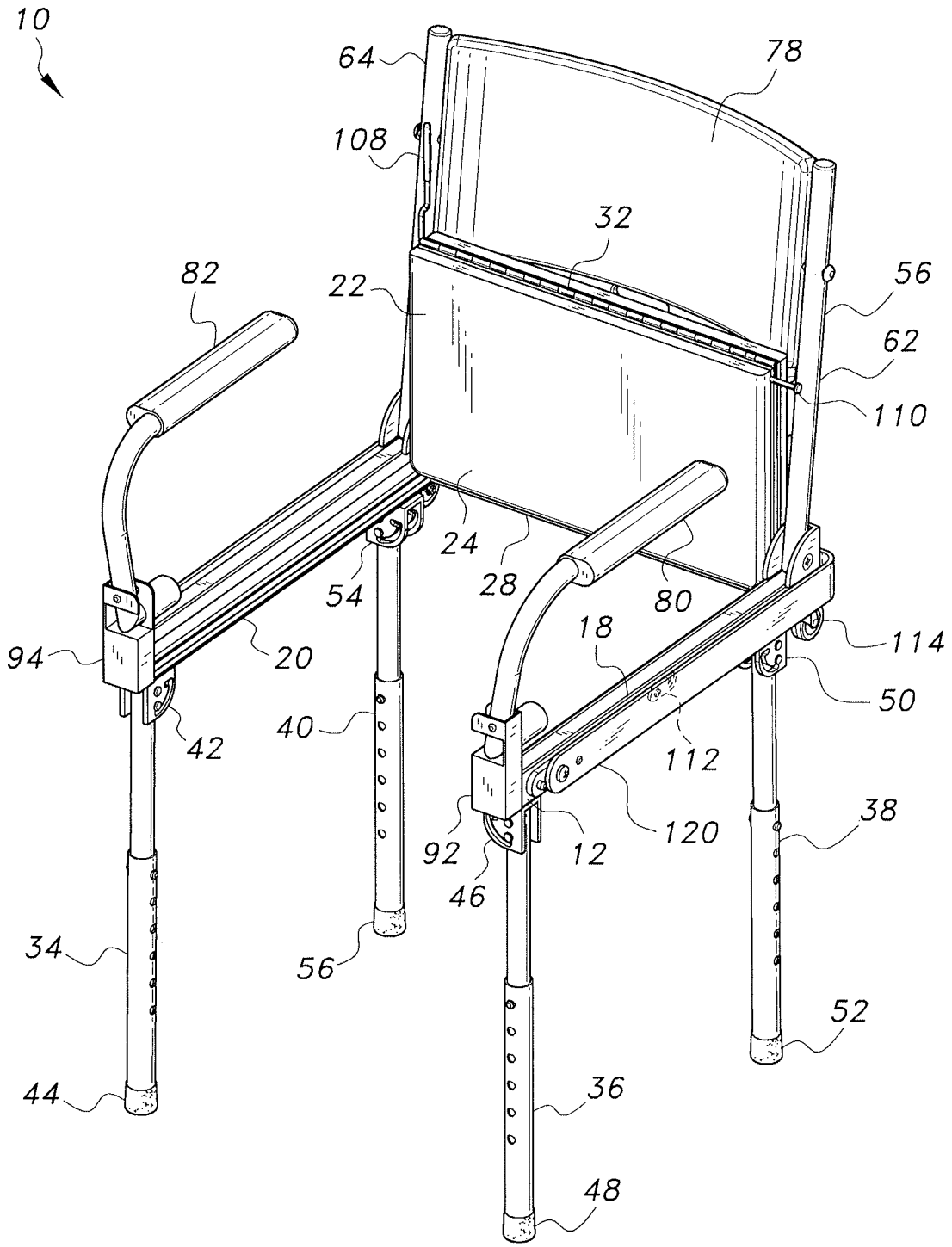
FIG. 3B is a perspective view of the collapsible chair of FIG. 3A, showing the seat in a fully collapsed state.

The seat 22 has opposed first and second side edges 104, 106, respectively. As best shown in FIGS. 2A and 2B, a post 110 may be secured to and extend from one of the side edges (first side edge 104 in FIGS. 2A and 2B). A corresponding hook 112 is pivotally attached to a corresponding one of the side bars 18, 20 of the seat frame 12 (side bar 18 in FIGS. 2A and 2B). In FIG. 2A, the hook 112 is shown engaging the post 110 to lock the seat 22 into the fully deployed position of FIG. 1. In FIG. 2B, the hook 112 is shown disengaged from the post 110, allowing the seat 22 to be folded, as shown in FIGS. 3A and 3B. Additionally, a handle 108 may be secured to the seat 22 opposite the post 110, allowing the user a handhold for collapsing and deploying the seat 22. In FIG. 1, the post 110 is secured to first side edge 104 of the seat 22. Thus, in this embodiment, the handle 108 is attached to the second side edge 106.

Figure 4A:
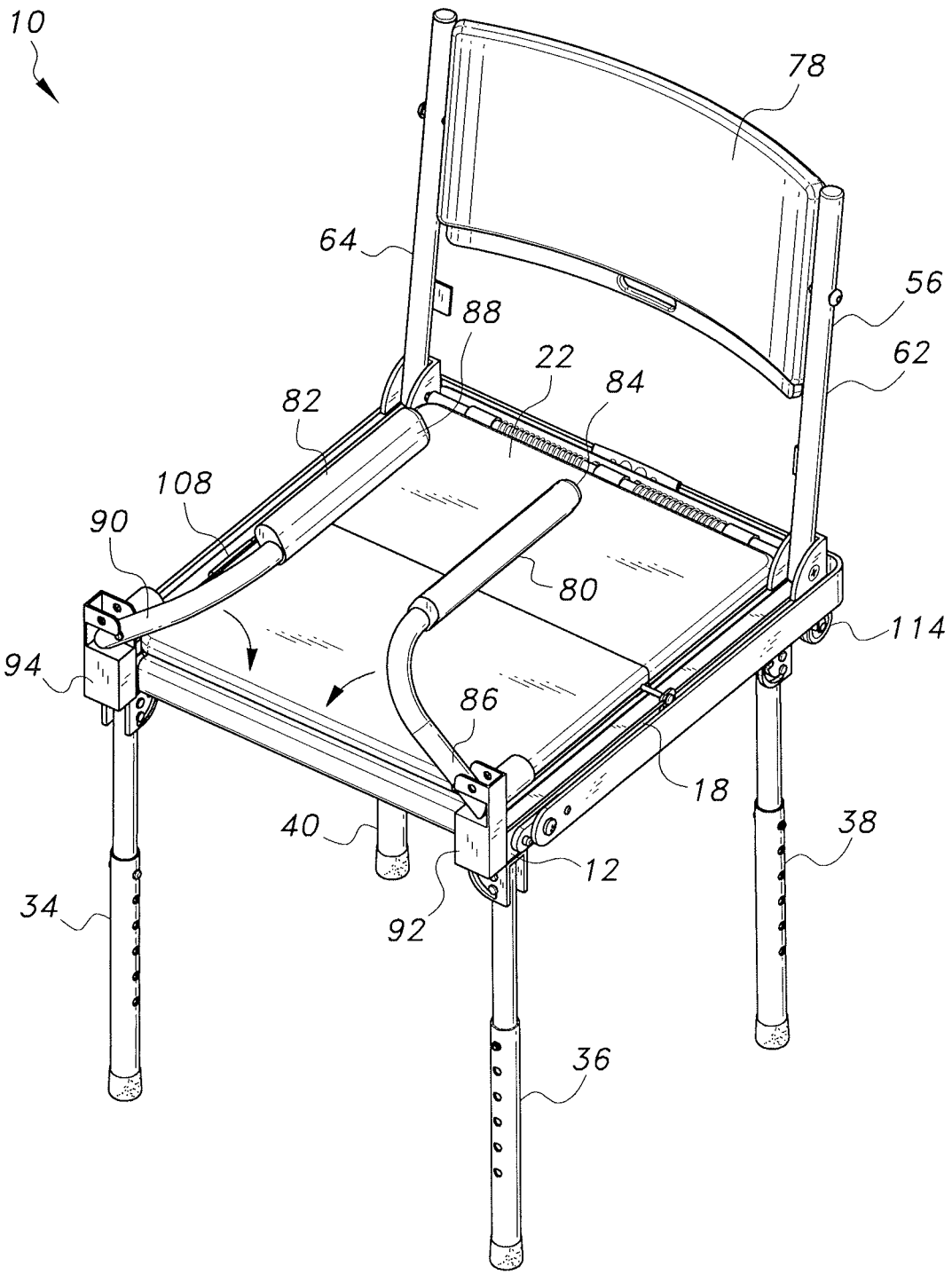
FIG. 4A is a perspective view of the collapsible chair of FIG. 1, showing the arm rests in a partially collapsed state.
Figure 4B:
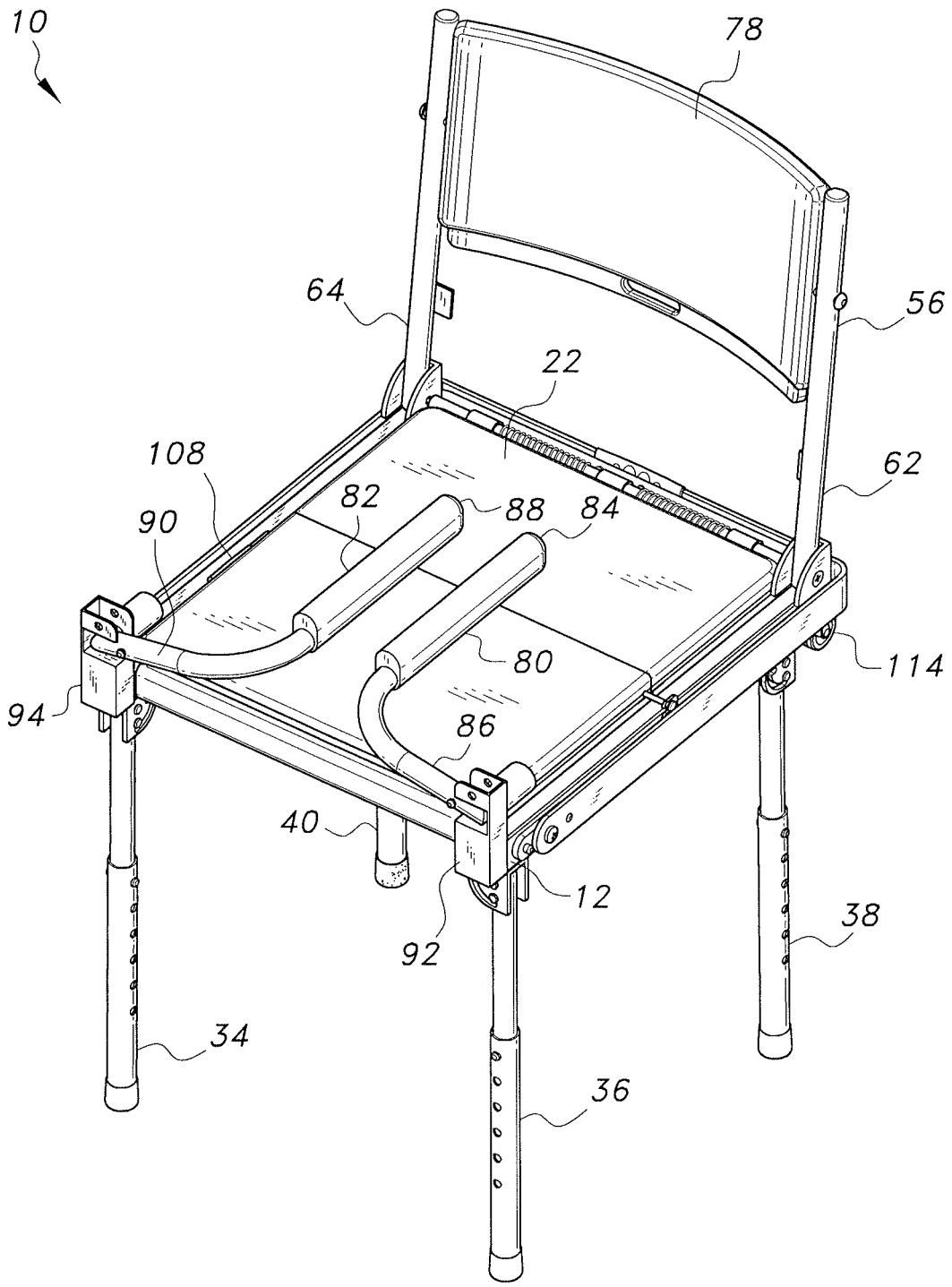
FIG. 4B is a perspective view of the collapsible chair of FIG. 4A, showing the pair of arm rests in a fully collapsed state.
Figure 4C:
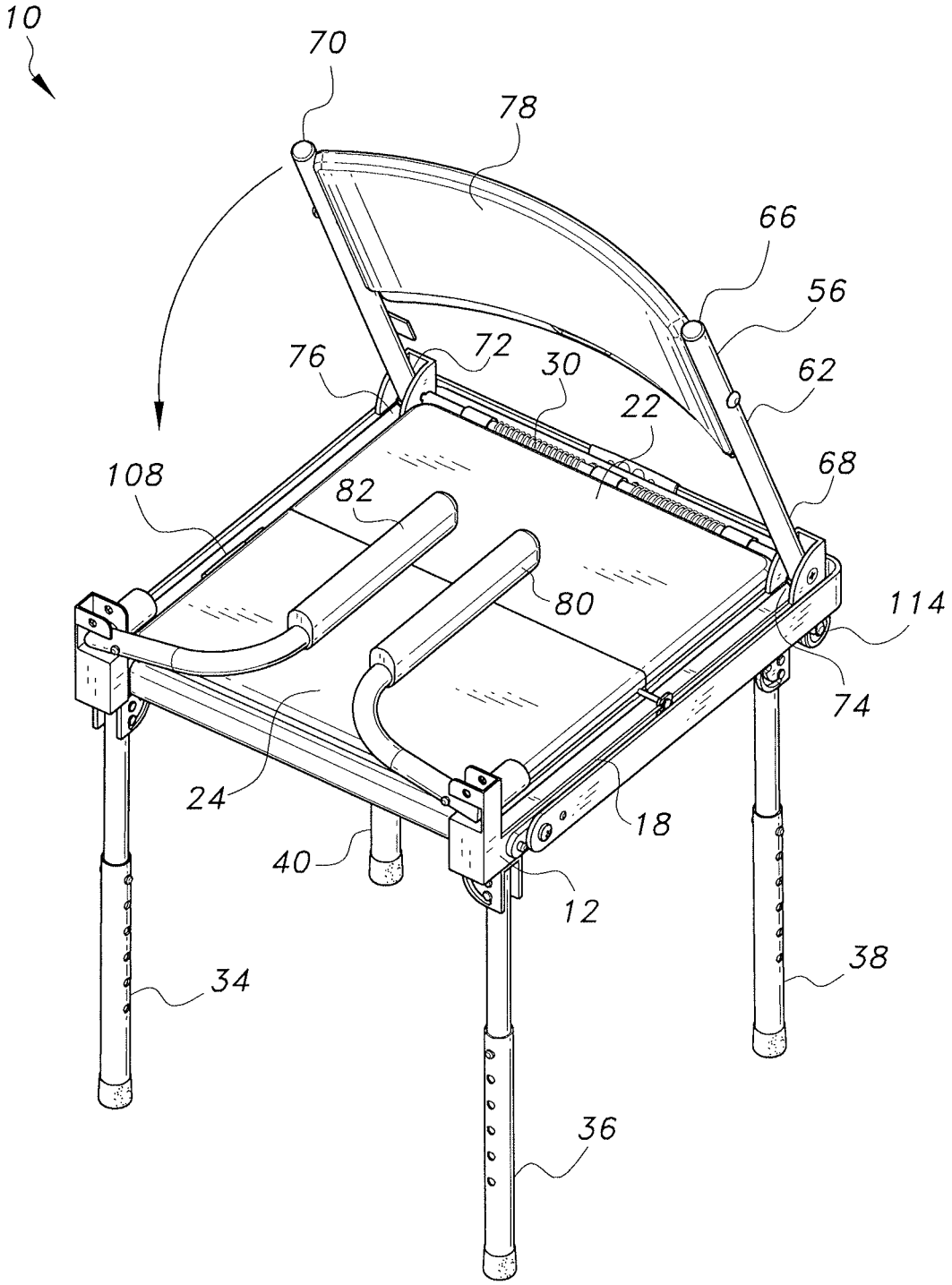
FIG. 4C is a perspective view of the collapsible chair of FIG. 1, showing the back rest in a partially folded state.
Figure 4D:
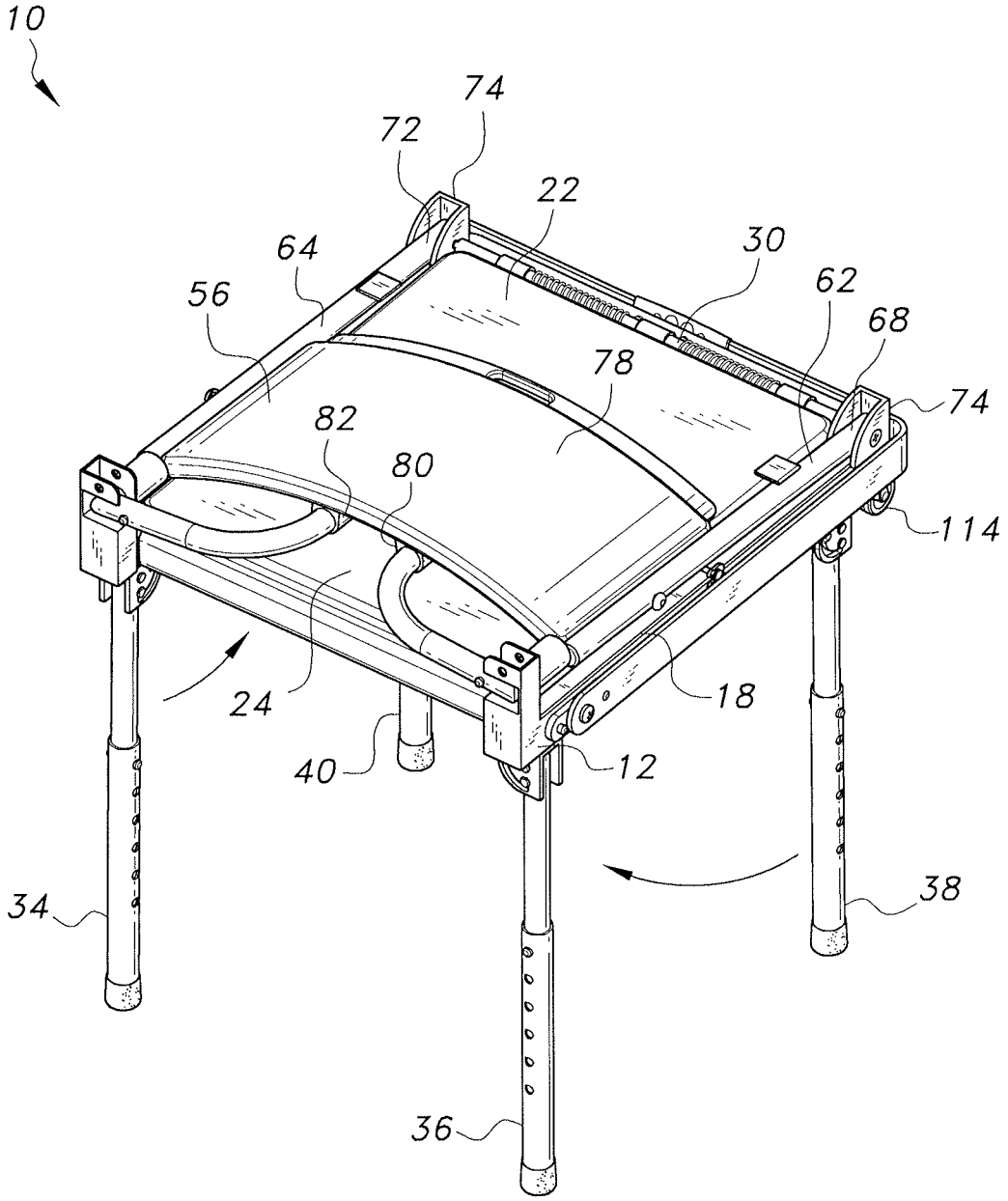
FIG. 4D is a perspective view of the collapsible chair of FIG. 4C, showing the back rest in a fully collapsed state.
Figure 4E:
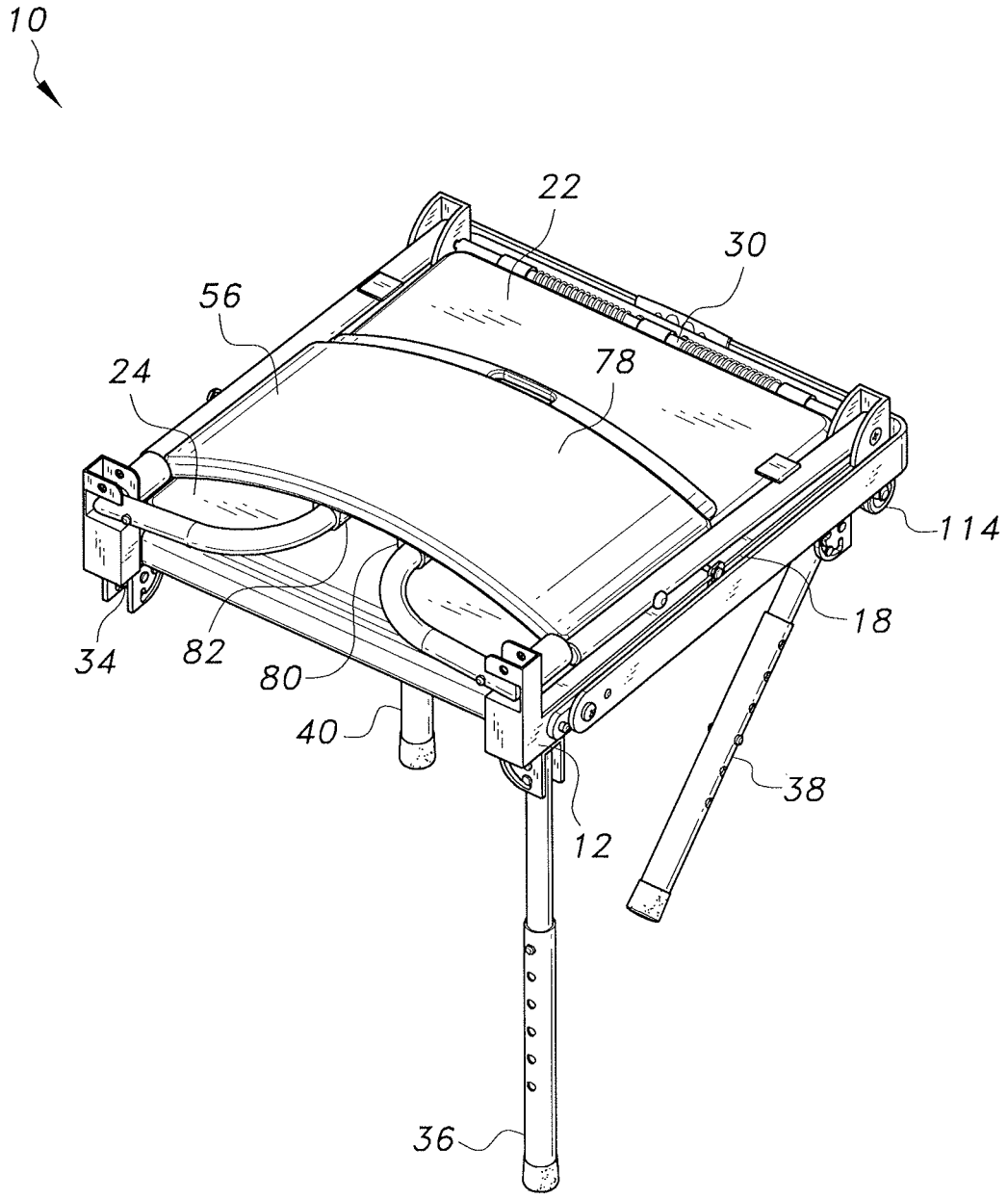
FIG. 4E is a perspective view of the collapsible chair in the configuration of FIG. 4D, shown with a first pair of legs in a partially folded state.
Figure 4F:
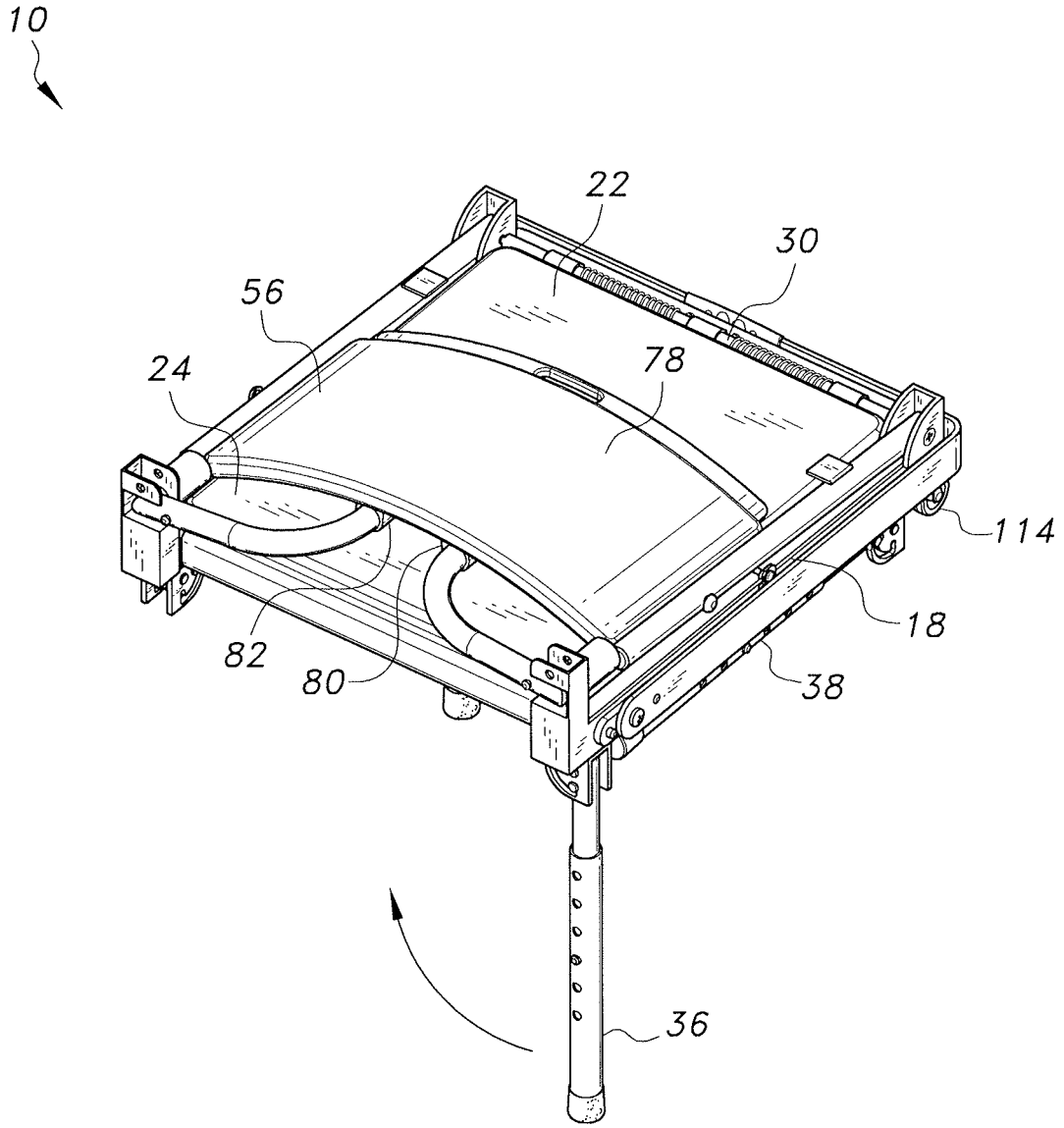
FIG. 4F is a perspective view of the collapsible chair in the configuration of FIG. 4D, shown with the first pair of legs in a fully folded state.
Figure 4G:
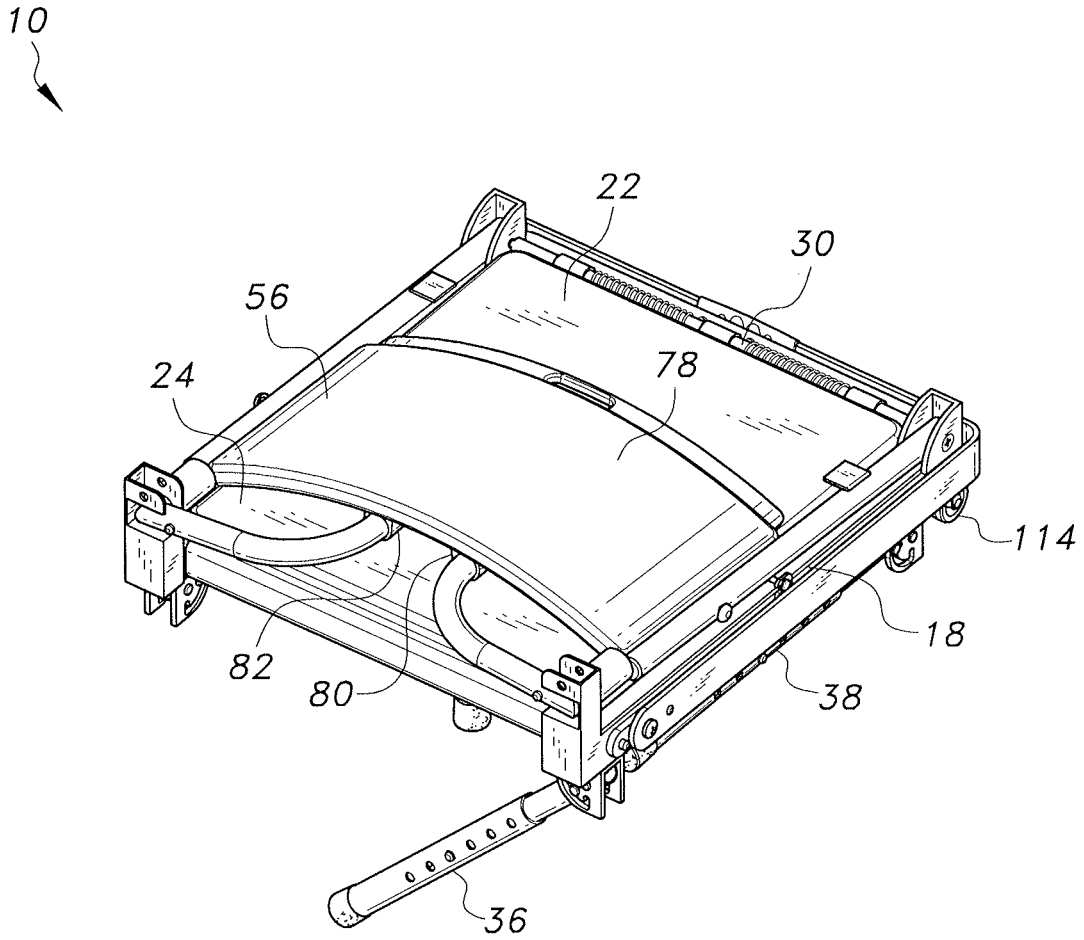
FIG. 4G is a perspective view of the collapsible chair in the configuration of FIG. 4F, shown with a second pair of legs in a partially folded state.
Figure 4H:
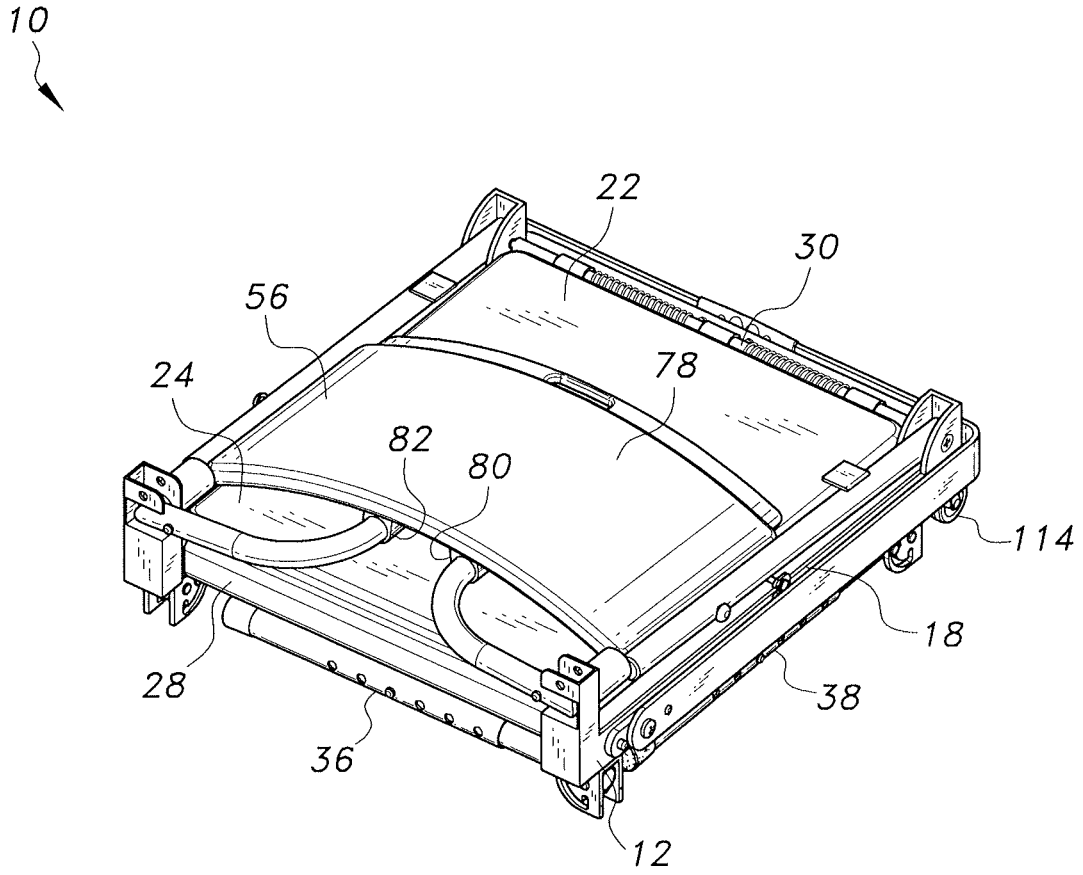
FIG. 4H is a perspective view of the collapsible chair in the configuration of FIG. 4F, shown with the second pair of legs in a fully folded state.

The chair 10 has a plurality of legs 34, 36, 38, 40. Although four such legs are shown, it should be understood that the chair 10 may have any suitable number of legs. Leg 34 has opposed upper and lower ends 42, 44, respectively; leg 36 has opposed upper and lower ends 46, 48, respectively; leg 38 has opposed upper and lower ends 50, 52, respectively; and leg 40 has a lower end 56 and an opposed upper end 54 (shown in FIG. 3B). The upper end of each leg is pivotally attached to the seat frame 12 by hinges or the like, and the legs are selectively foldable against the frame 12. In FIG. 4E, legs 38 and 34 are shown being folded, such that they may rest against the side bars 18, 20, respectively, of the seat frame 12, as shown in FIG. 4F. In FIG. 4G, legs 36 and 40 are shown being folded, such that they may rest against the front edge 28 of the seat 22 and the rear bar 30 of the seat frame 12, respectively, as shown in FIG. 4H. The legs 34, 36, 38, 40 may have telescoping sections selectively locked by detent pins, allowing each leg to either be further collapsed, or to have an adjustable height. It should, however, be understood that the overall dimensions and configuration of the legs 34, 36, 38, 40 shown in the drawings are for exemplary purposes only.

The chair 10 has a back rest 56, which, as shown in FIG. 1, may include a pair of arms 62, 64 and a back support 78 extending between the arms 62, 64. However, it should be understood that any suitable type of back rest may be used, including a back rest having any desired style, dimensions and configuration. In FIG. 1, the first arm 62 has opposed upper and lower ends 58, 68, respectively, and, similarly, the second arm 64 has opposed upper and lower ends 70, 72, respectively. Each of the lower ends 68, 72 are pivotally attached to rear ends 74, 76, respectively, of the side bars 18, 20 of the seat frame 12. In FIG. 1, the lower end 68 is pivotally attached to rear end 74 within a hinge housing 60. and similarly, lower end 72 is pivotally attached to rear end 76 within a corresponding hinge housing 61. Hinge housings 60, 61 are provided to protect the respective pivotal connections and ensure proper folding alignment. In FIG. 1, back support 78 is shown positioned adjacent the upper ends 58, 70 of the arms 62, 64, respectively, although, as discussed above, any suitable type of back rest, including a back support, may be used.

Additionally, as shown in FIG. 1, a pair of arm rests 80, 82 may be secured to the side bars 18, 20, respectively, of the seat frame 12. It should be understood that arm rests 80, 82 are shown for exemplary purposes only, and that any suitable type of arm rests may be utilized, including arm rests having any desired dimensions and configuration. As shown in FIG. 4A, arm rest 80 has a fixed end 86 and a free end 84. Similarly, arm rest 82 also has a fixed end 90 and a free end 88. The fixed ends 86, 90 are pivotally attached to the front ends 92, 94 of the side bars 18, 20, respectively, of the seat frame 12. FIG. 1 shows the arm rests 80, 82 in their fully deployed position. In FIG. 4A, the arm rests 80, 82 are partially folded (inwardly, toward one another), and FIG. 4B shows the arm rests 80, 82 in their fully collapsed position, resting against the seat 22.

Figure 5:
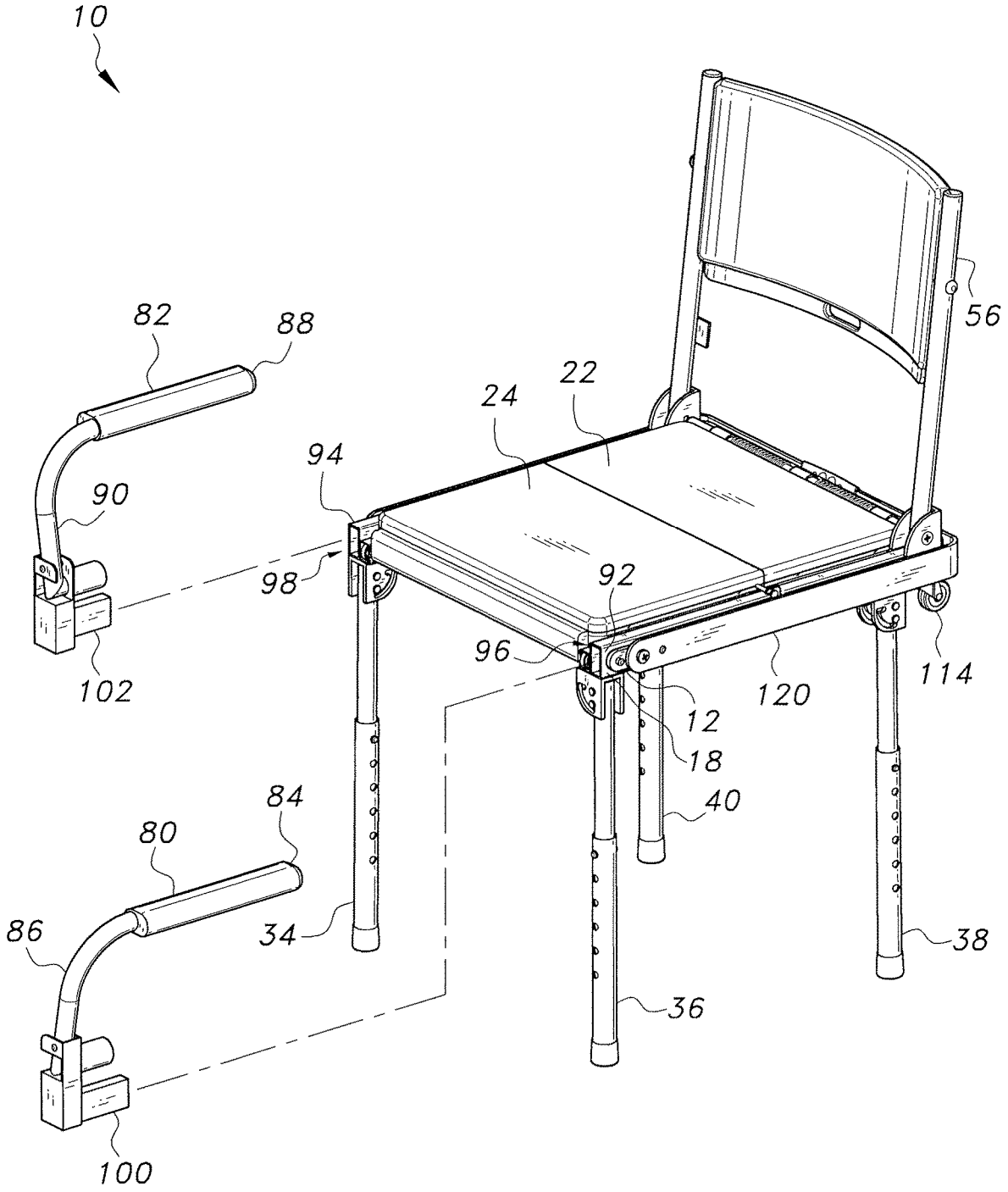
FIG. 5 is a partially exploded perspective view of the collapsible chair of FIG. 1.

As shown in FIG. 5, the arm rests 80, 82 may be releasably attached to the seat frame 12. Although it should be understood that any suitable type of releasable attachment may be used, in FIG. 5, the front end 92 of the side bar 18 has a recess 96 formed therein. Similarly, the front end 94 of the side bar 20 has a recess 98 formed therein. The recesses 96, 98 releasably receive respective engaging members 100, 102 of the corresponding fixed ends 86, 90 of the pair of arm rests 80, 82.

As discussed above, the back rest 56 is pivotally attached to the seat frame 12, allowing the back rest 56 to be folded against the seat 22. FIG. 1 shows the back rest 56 in its fully upright position, and FIG. 4C shows the back rest 56 being folded toward the seat 22. In FIG. 4D, following the full folding of the arm rests 80, 82, the back rest 56 is shown in the fully collapsed position, such that the back support 78 is above (and secures) the arm rests 80, 82 against the seat 22.

Figure 4I:
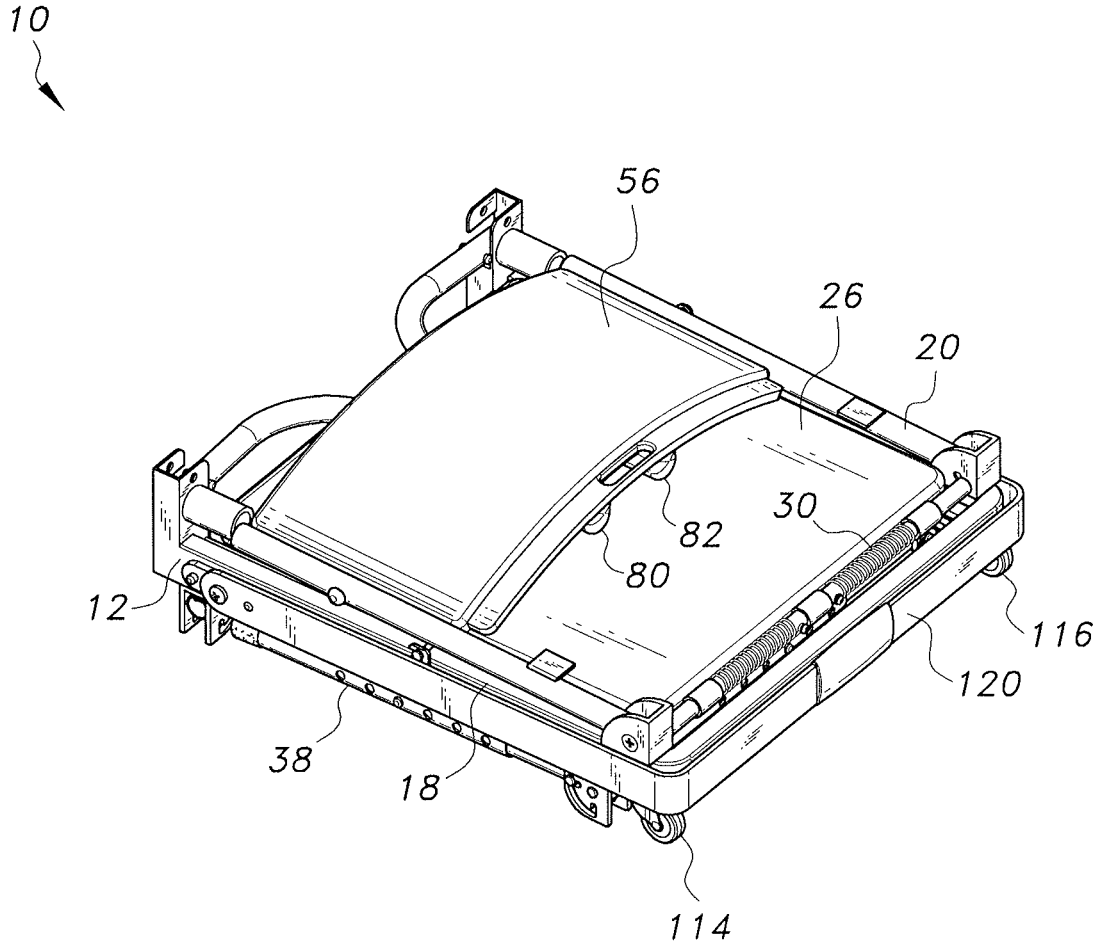
FIG. 4I is a rear perspective view of the collapsible chair in the configuration of FIG. 4H.
Figure 6:
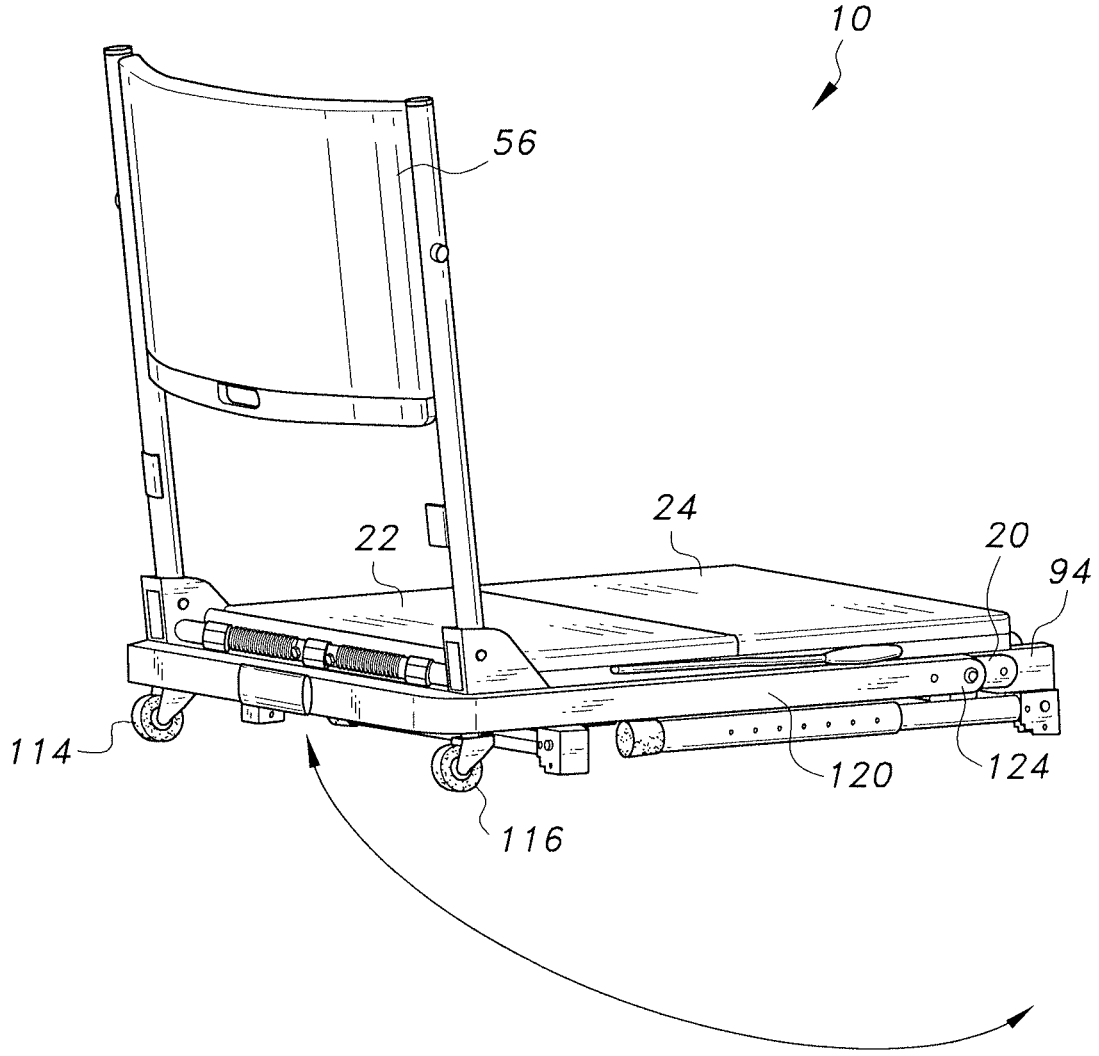
FIG. 6 is a perspective view of the collapsible chair of FIG. 1 in a partially collapsed configuration, shown with a substantially U-shaped carrying handle in a fully collapsed position.
Figure 7:
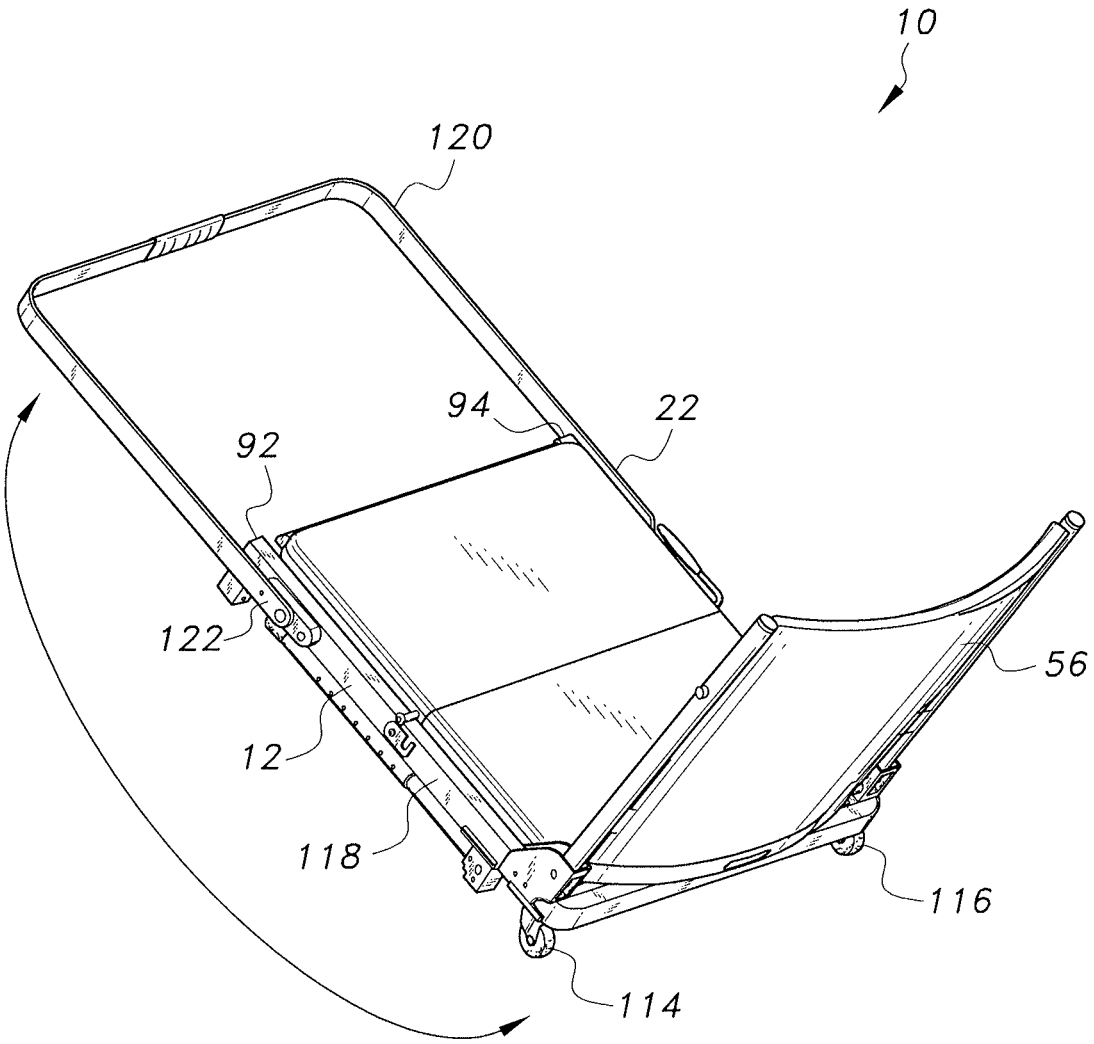
FIG. 7 is a perspective view of the collapsible chair in the partially collapsed configuration of FIG. 6, shown with the substantially U-shaped carrying handle rotated into a deployed position.

Further, as best seen in FIG. 4I, one or more casters 114, 116 may be secured to the rear of the seat frame 12. In either the fully collapsed state of FIG. 4I, or in a partially collapsed state, such as that shown in FIG. 6 and/or FIG. 7, the casters 114, 116 allow the user to easily transport the collapsed chair 10 to a desired location. Further, in order to either lift and carry the collapsed chair 10 in its collapsed state, or to easily roll the collapsed chair using the casters 114, 116, a substantially U-shaped carrying handle 120 may be further provided. As shown in FIGS. 6 and 7, the substantially U-shaped carrying handle 120 has a pair of ends 122, 124, respectively, that are pivotally attached to the front ends 92, 94 of the side bars 18, 20 of the seat frame 12. In FIG. 6, the substantially U-shaped carrying handle 120 is shown in its fully collapsed position. In order to deploy the substantially U-shaped carrying handle 120, handle 120 is pivoted about its ends 122, 124 to swing into the position shown in FIG. 7.

It is to be understood that the collapsible chair is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A collapsible chair, comprising:

a seat frame having a rear bar and a pair of side bars extending from the rear bar, the seat frame having an open front end;

a seat having opposed front and rear edges, the seat including front and rear portions pivotally attached to one another, the rear edge of the seat being pivotally attached to the rear bar of the seat frame, the front edge of the seat being slidably and pivotally attached to the pair of side bars of the seat frame, the front and rear portions being selectively foldable with respect to one another and with respect to the seat frame;

a plurality of legs, each of the legs having an upper end and a lower end, the upper end of each of the legs being pivotally attached to the seat frame and selectively and independently foldable against the seat frame; and a back rest having opposed upper and lower ends, the lower end of the back rest being pivotally attached to the rear bar of the seat frame.

2. The collapsible chair as recited in claim 1, wherein the back rest comprises:

a pair of arms, each of the arms having opposed upper and lower ends, the lower ends of the arms being pivotally attached to the pair of side bars of the seat frame; and a back support extending between the pair of arms adjacent the upper ends thereof.

3. The collapsible chair as recited in claim 1, further comprising a pair of arm rests pivotally attached to the pair of side bars of said seat frame.

4. The collapsible chair as recited in claim 3, wherein each said arm rest has a fixed end and a free end, each of the fixed ends having an engaging member, the fixed ends of the arm rests being pivotally attached to the pair of side bars of said seat frame.

5. The collapsible chair as recited in claim 4, wherein each said side bar has a recess formed therein, the recess selectively receiving the corresponding engaging member of a respective one of the fixed ends of said arm rests.

6. The collapsible chair as recited in claim 1, wherein:

said seat has opposed first and second side edges, said seat having a post extending from the first side edge; and a corresponding one of the side bars of the seat frame has a hook pivotally attached thereto, the hook selectively engaging the post to selectively lock the seat in a deployed position with respect to the seat frame.

7. The collapsible chair as recited in claim 6, further comprising a handle attached to the second side edge of the seat.

8. The collapsible chair as recited in claim 1, further comprising at least one caster attached to the rear bar of said seat frame.

9. The collapsible chair as recited in claim 1, further comprising a substantially U-shaped carrying handle having a pair of ends pivotally attached to the side bars of said seat frame.

10. A collapsible chair, comprising:

a seat frame having a rear bar and a pair of side bars extending from the rear bar, the seat frame having an open front end;

a seat having opposed front and rear edges, the seat including front and rear portions pivotally attached to one another, the rear edge of the seat being pivotally attached to the rear bar of the seat frame, the front edge of the seat being slidably and pivotally attached to the pair of side bars of the seat frame, the front and rear portions being selectively foldable with respect to one another and with respect to the seat frame;

a plurality of legs, each of the legs having an upper end and a lower end, the upper end of each of the legs being pivotally attached to the seat frame and being selectively foldable against the seat frame;

a back rest having opposed upper and lower ends, the lower end of the back rest being pivotally attached to the rear bar of the seat frame; and at least one caster attached to the rear bar of the seat frame.

11. The collapsible chair as recited in claim 10, wherein the back rest comprises:

a pair of arms, each of the arms having opposed upper and lower ends, the lower ends of the arms being pivotally attached to the pair of side bars of the seat frame; and a back support extending between the arms adjacent the upper ends thereof.

12. The collapsible chair as recited in claim 10, further comprising a pair of arm rests secured to the pair of side bars of said seat frame.

13. The collapsible chair as recited in claim 12, wherein each said arm rest has a fixed end and a free end, each of the fixed ends has an engaging member, the fixed ends being pivotally attached to the side bars of said seat frame.

14. The collapsible chair as recited in claim 13, wherein each said side bar has a front end and a recess formed in the front end, the recesses selectively receiving the corresponding engaging member of a respective one of the fixed ends of said arm rests.

15. The collapsible chair as recited in claim 10, wherein:

said seat has opposed first and second side edges, said seat having a post extending from the first side edge; and a corresponding one of the side bars of the seat frame has a hook pivotally attached thereto, the hook selectively engaging the post to selectively lock the seat in a deployed position with respect to the seat frame.

16. The collapsible chair as recited in claim 15, further comprising a handle attached to the second side edge of the seat.

17. The collapsible chair as recited in claim 10, further comprising a substantially U-shaped carrying handle having a pair of ends pivotally attached to the side bars of said seat frame.

18. A collapsible chair, comprising:

a seat frame having a rear bar and a pair of side bars extending from the rear bar, the seat frame having an open front end;

a seat having opposed front and rear edges, the seat including front and rear portions pivotally attached to one another, the rear edge of the seat being pivotally attached to the rear bar of the seat frame, the front edge of the seat being slidably and pivotally attached to the side bars of the seat frame, the front and rear portions being selectively foldable with respect to one another and with respect to the seat frame;

a plurality of legs, each of the legs having an upper end and a lower end, the upper end of each of the legs being pivotally secured to the seat frame and selectively foldable against the seat frame;

a back rest having opposed upper and lower ends, the lower ends being pivotally attached to the rear bar of the seat frame; and a substantially U-shaped carrying handle having a pair of ends pivotally attached to the side bars of the seat frame.

19. The collapsible chair as recited in claim 18, further comprising a pair of arm rests respectively attached to the side bars of said seat frame.

20. The collapsible chair as recited in claim 18, wherein:

said seat has opposed first and second side edges, said seat having a post extending from the first side edge; and a corresponding one of the side bars of the seat frame has a hook pivotally attached thereto, the hook selectively engaging the post to selectively lock the seat in a deployed position with respect to the seat frame.

* * * * *